US009967691B2

(12) United States Patent
Liu et al.

(10) Patent No.: US 9,967,691 B2
(45) Date of Patent: May 8, 2018

(54) STEREOPHONIC SOUND RECORDING METHOD AND APPARATUS, AND TERMINAL

(71) Applicant: Huawei Technologies Co., Ltd., Shenzhen (CN)

(72) Inventors: Li Liu, Shanghai (CN); Qing Chang, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 55 days.

(21) Appl. No.: 15/056,275

(22) Filed: Feb. 29, 2016

(65) Prior Publication Data

US 2016/0183026 A1 Jun. 23, 2016

Related U.S. Application Data

(63) Continuation of application No. PCT/CN2014/085646, filed on Sep. 1, 2014.

(30) Foreign Application Priority Data

Aug. 30, 2013 (CN) ..... 2013 1 0389101

(51) Int. Cl.
*H04S 7/00* (2006.01)
*H04S 1/00* (2006.01)
(Continued)

(52) U.S. Cl.
CPC ..... *H04S 7/303* (2013.01); *H04R 3/005* (2013.01); *H04R 29/004* (2013.01); *H04S 1/00* (2013.01);
(Continued)

(58) Field of Classification Search
CPC ..... H04S 7/303; H04S 1/00; H04S 2400/15; H04R 3/005; H04R 29/004; H04R 2499/11; H04M 1/03
See application file for complete search history.

(56) References Cited

U.S. PATENT DOCUMENTS 6,748,088 B1 6/2004 Schaaf
2008/0056517 A1* 3/2008 Algazi ..... H04S 7/304 381/310
(Continued)

FOREIGN PATENT DOCUMENTS

CN 2747802 Y 12/2005
CN 101727964 A 6/2010
(Continued)

OTHER PUBLICATIONS

Partial English Translation and Abstract of Chinese Patent Application No. CN103473028, Mar. 7, 2016, 3 pages.
(Continued)

*Primary Examiner* — Jason R Kurr
(74) *Attorney, Agent, or Firm* — Conely Rose, P.C.

(57) ABSTRACT

A stereophonic sound recording method, apparatus and a terminal pertain to the field of audio and video technologies. The method includes acquiring an initial gesture parameter of the terminal when recording starts, where the terminal is equipped with two or more microphones; acquiring a current gesture parameter of the terminal in a recording process; acquiring a gesture change parameter of the terminal when it is determined, according to the current gesture parameter and initial gesture parameter of the terminal, that a gesture of the terminal changes; acquiring, according to the gesture change parameter of the terminal, a weight factor corresponding to the gesture change parameter of the terminal; and separately writing, according to the weight factor corresponding to the gesture change parameter of the terminal,
(Continued)

audio data collected by the two or more microphones into a left channel and a right channel.

14 Claims, 7 Drawing Sheets

(51) Int. Cl.
*H04R 3/00* (2006.01)
*H04R 29/00* (2006.01)

(52) U.S. Cl.
CPC ..... *H04R 2499/11* (2013.01); *H04S 2400/15* (2013.01)

(56) References Cited

U.S. PATENT DOCUMENTS

2009/0308230 A1 12/2009 Kayama
2010/0100209 A1 4/2010 Wakabayashi
2012/0128175 A1* 5/2012 Visser ..... H04R 3/005 381/92
2012/0207308 A1* 8/2012 Sung ..... H04S 7/304 381/17
2013/0083944 A1* 4/2013 Kvist ..... H04R 3/005 381/92
2013/0177168 A1* 7/2013 Inha ..... H04N 5/602 381/92
2014/0211950 A1* 7/2014 Neufeld ..... H04R 5/04 381/23
2015/0208156 A1* 7/2015 Virolainen ..... H04S 7/303 381/92

FOREIGN PATENT DOCUMENTS

CN 201639630 U 11/2010
CN 102082991 A 6/2011
CN 103473028 A 12/2013
WO 2012061151 A1 5/2012
WO 2014012583 A1 1/2014

OTHER PUBLICATIONS

Foreign Communication From a Counterpart Application, European Application No. 14841265.3, Extended European Search Report dated Jul. 7, 2016, 7 pages.
Foreign Communication From a Counterpart Application, Chinese Application No. 201310389101.8, Chinese Office Action dated Sep. 6, 2015, 6 pages.
Foreign Communication From a Counterpart Application, PCT Application No. PCT/CN2014/085646, English Translation of International Search Report dated Nov. 26, 2014, 2 pages.
Foreign Communication From a Counterpart Application, PCT Application No. PCT/CN2014/085646, English Translation of Written Opinion dated Nov. 26, 2014, 9 pages.

* cited by examiner

STEREOPHONIC SOUND RECORDING METHOD AND APPARATUS, AND TERMINAL

CROSS-REFERENCE TO RELATED APPLICATIONS

This application is a continuation of International Application No. PCT/CN2014/085646, filed on Sep. 1, 2014, which claims priority to Chinese Patent Application No. 201310389101.8, filed on Aug. 30, 2013, both of which are hereby incorporated by reference in their entireties.

TECHNICAL FIELD

The present disclosure relates to the field of audio technologies, and in particular, to a stereophonic sound recording method and apparatus, and a terminal.

BACKGROUND

A stereophonic sound is a sound having a stereo perception. The stereophonic sound features a sense of space distribution and a sense of layering. All sounds in the nature are stereophonic sounds.

In order to record a stereophonic sound on a mobile phone platform, the mobile phone platform requires at least two recording microphones. During recording, the two recording microphones need to work simultaneously, and there is a specific distance between the microphones. Different microphones respectively collect audio data in different parts of a sound field, and the collected audio data is respectively written into a left channel and a right channel, so as to produce an effect of a stereophonic sound field.

In a process of implementing the present disclosure, the inventor finds that at least the following problems exist.

In an entire process of stereophonic sound recording, correspondences between a left/right channel and multiple microphones are fixed and unchanged. As a result, audio data of the left channel and the right channel is of unitary composition, and a sound channel receives only a sound collected by a microphone permanently corresponding to the sound channel, for example, audio data collected by a primary microphone is written into the right channel, and audio data collected by a secondary microphone is written into the left channel. Therefore, in the recording process, if a location of a microphone changes, but composition of data collected by each microphone cannot change accordingly, a recording sound field is disordered, affecting a recording effect of a stereophonic sound. For example, a mobile phone equipped with two microphones is used to record a performance of a symphony orchestra, where a primary microphone faces to the right and mainly records a cello sound on the right of a stage, and a secondary microphone faces to the left and mainly records a trumpet sound on the left of the stage. A user hopes that a recorded cello sound always sounds on the right of a sound field and a recorded trumpet sound always sounds on the left of the sound field. However, in the recording process, if the user rotates a gesture of the mobile phone so that facing directions of the recording primary and secondary microphones are interchanged, that is, the primary microphone faces to the left and the secondary microphone faces to the right, according to an existing stereophonic sound recording technology, the cello sound turns to the left of the sound field, and the trumpet sound that is originally on the left of the sound field turns to the right of the sound field. In a case in which the real sound field does not change, a final recording result is that the cello sound sounds from the right to the left and the trumpet sound sounds from the left to the right, that is, a recording sound field is in a reverse order.

SUMMARY

To resolve a problem, embodiments of the present disclosure provide a stereophonic sound recording method and apparatus, and a terminal. The technical solutions are as follows.

According to a first aspect, a stereophonic sound recording method is provided, where the method includes acquiring an initial gesture parameter of a terminal when recording starts, where the terminal is equipped with two or more microphones; acquiring a current gesture parameter of the terminal in a recording process; acquiring a gesture change parameter of the terminal when it is determined, according to the current gesture parameter and initial gesture parameter of the terminal, that a gesture of the terminal changes; acquiring, according to the gesture change parameter of the terminal, a weight factor corresponding to the gesture change parameter of the terminal, where the weight factor is used to adjust a proportion of audio data, collected by each microphone, to be written into a left channel and a right channel, and there is a preset correspondence between the gesture change parameter and the weight factor; and separately writing, according to the weight factor corresponding to the gesture change parameter of the terminal, audio data collected by the two or more microphones into the left channel and the right channel.

With reference to the first aspect, in a first possible implementation manner of the first aspect, the terminal is equipped with a sensor, and the acquiring a current gesture parameter of the terminal in a recording process includes, in the recording process, periodically acquiring a gesture parameter output by the sensor of the terminal and using the gesture parameter as the current gesture parameter; or monitoring the sensor of the terminal in the recording process, and when a gesture parameter output by the sensor is different from the initial gesture parameter, acquiring the gesture parameter output by the sensor and using the gesture parameter as the current gesture parameter of the terminal.

With reference to the first aspect, in a second possible implementation manner of the first aspect, the acquiring a gesture change parameter of the terminal when it is determined, according to the current gesture parameter and initial gesture parameter of the terminal, that a gesture of the terminal changes includes converting the initial gesture parameter of the terminal into a vector $\vec{\alpha}=(x_o,y_o,z_o)$ in a world coordinate system; converting the current gesture parameter of the terminal into a vector $\vec{\beta}=(x_c,y_c,z_c)$ in the world coordinate system; and determining a gesture change parameter $\Delta\theta$ of the gesture of the terminal by using a formula $$\cos\Delta\theta = \cos\langle\vec{\alpha}, \vec{\beta}\rangle = \frac{\vec{\alpha}\cdot\vec{\beta}}{|\vec{\alpha}|*|\vec{\beta}|},$$

where $x_o,y_o,z_o \in Z$.

With reference to the first aspect, in a third possible implementation manner of the first aspect, when the two or more microphones are respectively a primary microphone and a secondary microphone, the separately writing, according to the weight factor corresponding to the gesture change parameter of the terminal, audio data collected by the two or more microphones into the left channel and the right channel includes separately writing, according to the weight factor corresponding to the gesture change parameter of the terminal and by using the following composition formulas of the left channel and the right channel, the audio data collected by the primary microphone and the secondary microphone into the left channel and the right channel:

$$L=S^*(1-\omega)+P^*(\omega)$$

$$R=S^*(\omega)+P^*(1-\omega)$$

where ω indicates the weight factor, L indicates the left channel, R indicates the right channel, S indicates the audio data collected by the secondary microphone, and P indicates the audio data collected by the primary microphone.

According to a second aspect, a stereophonic sound recording apparatus is provided, where the apparatus includes an initial gesture parameter acquiring module configured to acquire an initial gesture parameter of a terminal when recording starts, where the terminal is equipped with two or more microphones; a current gesture parameter acquiring module configured to acquire a current gesture parameter of the terminal in a recording process; a gesture change parameter acquiring module configured to acquire a gesture change parameter of the terminal when it is determined, according to the current gesture parameter and initial gesture parameter of the terminal, that a gesture of the terminal changes; a weight factor acquiring module configured to acquire, according to the gesture change parameter of the terminal, a weight factor corresponding to the gesture change parameter of the terminal, where the weight factor is used to adjust a proportion of audio data, collected by each microphone, to written into a left channel and a right channel, and there is a preset correspondence between the gesture change parameter and the weight factor; and an audio data writing module configured to separately write, according to the weight factor corresponding to the gesture change parameter of the terminal, audio data collected by the two or more microphones into the left channel and the right channel.

With reference to the second aspect, in a first possible implementation manner of the second aspect, where the terminal is equipped with a sensor, and the current gesture parameter acquiring module is configured to, in the recording process, periodically acquire a gesture parameter output by the sensor of the terminal and use the gesture parameter as the current gesture parameter; or the current gesture parameter acquiring module is configured to monitor the sensor of the terminal in the recording process, and when a gesture parameter output by the sensor is different from the initial gesture parameter, acquire the gesture parameter output by the sensor and use the gesture parameter as the current gesture parameter of the terminal.

With reference to the second aspect, in a second possible implementation manner of the second aspect, the gesture change parameter acquiring module includes an initial gesture parameter converting unit configured to convert the initial gesture parameter of the device into a vector $\vec{\alpha}=(x_o,y_o,z_o)$ in a world coordinate system; a current gesture parameter converting unit configured to convert the current gesture parameter of the device into a vector $\vec{\beta}=(x_c,y_c,z_c)$ in the world coordinate system; and a gesture change parameter determining unit configured to determine a gesture change parameter Δθ of the gesture of the terminal by using a formula $$\cos\Delta\theta=\cos\langle\vec{\alpha},\vec{\beta}\rangle=\frac{\vec{\alpha}\cdot\vec{\beta}}{|\vec{\alpha}|*|\vec{\beta}|},$$

where $x_o,y_o,z_o\in Z$.

With reference to the second aspect, in a fourth possible implementation manner of the second aspect, the audio data writing module is configured to, when the two or more microphones are respectively a primary microphone and a secondary microphone, separately write, according to the weight factor corresponding to the gesture change parameter of the terminal and by using the following composition formulas of the left channel and the right channel, the audio data collected by the primary microphone and the secondary microphone into the left channel and the right channel:

$$L=S^*(1-\omega)+P^*(\omega)$$

$$R=S^*(\omega)+P^*(1-\omega)$$

where ω indicates the weight factor, L indicates the left channel, R indicates the right channel, S indicates the audio data collected by the secondary microphone, and P indicates the audio data collected by the primary microphone.

According to a third aspect, a terminal is provided, where the terminal includes a memory and one or more programs, the one or more programs are stored in the memory, and after configuration, a processor that includes one or more processing cores executes the one or more programs that include an instruction used for performing the following operations: acquiring an initial gesture parameter of the terminal when recording starts, where the terminal is equipped with two or more microphones; acquiring a current gesture parameter of the terminal in a recording process; acquiring a gesture change parameter of the terminal when it is determined, according to the current gesture parameter and initial gesture parameter of the terminal, that a gesture of the terminal changes; acquiring, according to the gesture change parameter of the terminal, a weight factor corresponding to the gesture change parameter of the terminal, where the weight factor is used to adjust a proportion of audio data, collected by each microphone, to be written into a left channel and a right channel, and there is a preset correspondence between the gesture change parameter and the weight factor; and separately writing, according to the weight factor corresponding to the gesture change parameter of the terminal, audio data collected by the two or more microphones into the left channel and the right channel.

The technical solutions provided in the embodiments of the present disclosure bring the following beneficial effects.

A current gesture parameter of a terminal is acquired in real time, and when it is determined, by comparing the current gesture parameter with an initial gesture parameter of the terminal, that a gesture of the terminal changes, a weight factor of audio data that is written by multiple microphones into a left channel and a right channel is calculated, and then a proportion of the audio data that is written by the multiple microphones into the left channel and the right channel is adjusted according to the weight factor, so that a sound field is not affected by a gesture change of the terminal and stability of a sound field of stereophonic sound recording is ensured.

BRIEF DESCRIPTION OF THE DRAWINGS

To describe the technical solutions in the embodiments of the present disclosure more clearly, the following briefly introduces the accompanying drawings required for describing the embodiments. The accompanying drawings in the following description show merely some embodiments of the present disclosure, and a person of ordinary skill in the art may still derive other drawings from these accompanying drawings without creative efforts.

DETAILED DESCRIPTION

To make the objectives, technical solutions, and advantages of the present disclosure clearer, the following further describes the embodiments of the present disclosure in detail with reference to the accompanying drawings.

Figure 1:
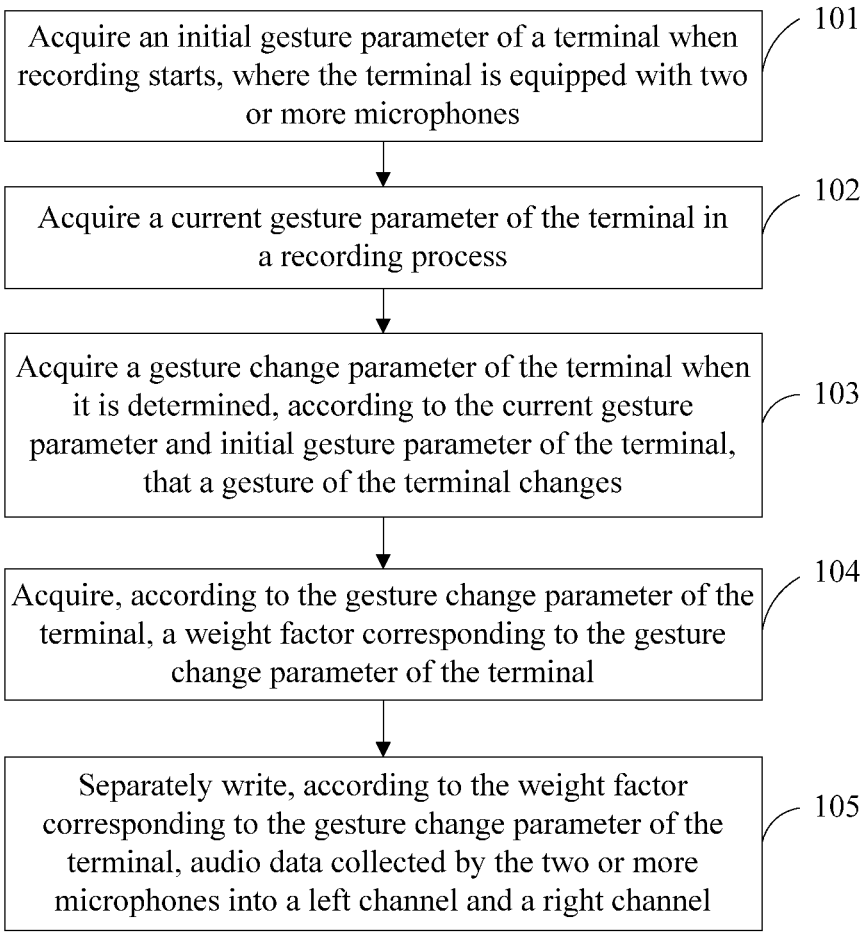
FIG. 1 is a flowchart of a stereophonic sound recording method according to an embodiment of the present disclosure.

FIG. 1 is a flowchart of a stereophonic sound recording method according to an embodiment of the present disclosure. Referring to FIG. 1, the method includes the following steps.

101. Acquire an initial gesture parameter of a terminal when recording starts, where the terminal is equipped with two or more microphones.

102. Acquire a current gesture parameter of the terminal in a recording process.

103. Acquire a gesture change parameter of the terminal when it is determined, according to the current gesture parameter and initial gesture parameter of the terminal, that a gesture of the terminal changes.

104. Acquire, according to the gesture change parameter of the terminal, a weight factor corresponding to the gesture change parameter of the terminal, where the weight factor is used to adjust a proportion of audio data, collected by each microphone, to be written into a left channel and a right channel, and there is a preset correspondence between the gesture change parameter and the weight factor.

105. Separately write, according to the weight factor corresponding to the gesture change parameter of the terminal, audio data collected by the two or more microphones into the left channel and the right channel.

In this embodiment of the present disclosure, a current gesture parameter of a terminal is acquired in real time, and when it is determined, by comparing the current gesture parameter with an initial gesture parameter of the terminal, that a gesture of the terminal changes, a weight factor of audio data that is written by multiple microphones into a left channel and a right channel is calculated, and then a proportion of the audio data that is written by the multiple microphones into the left channel and the right channel is adjusted according to the weight factor, so that a sound field is not affected by a gesture change of the terminal and stability of a sound field of stereophonic sound recording is ensured.

Figure 2:
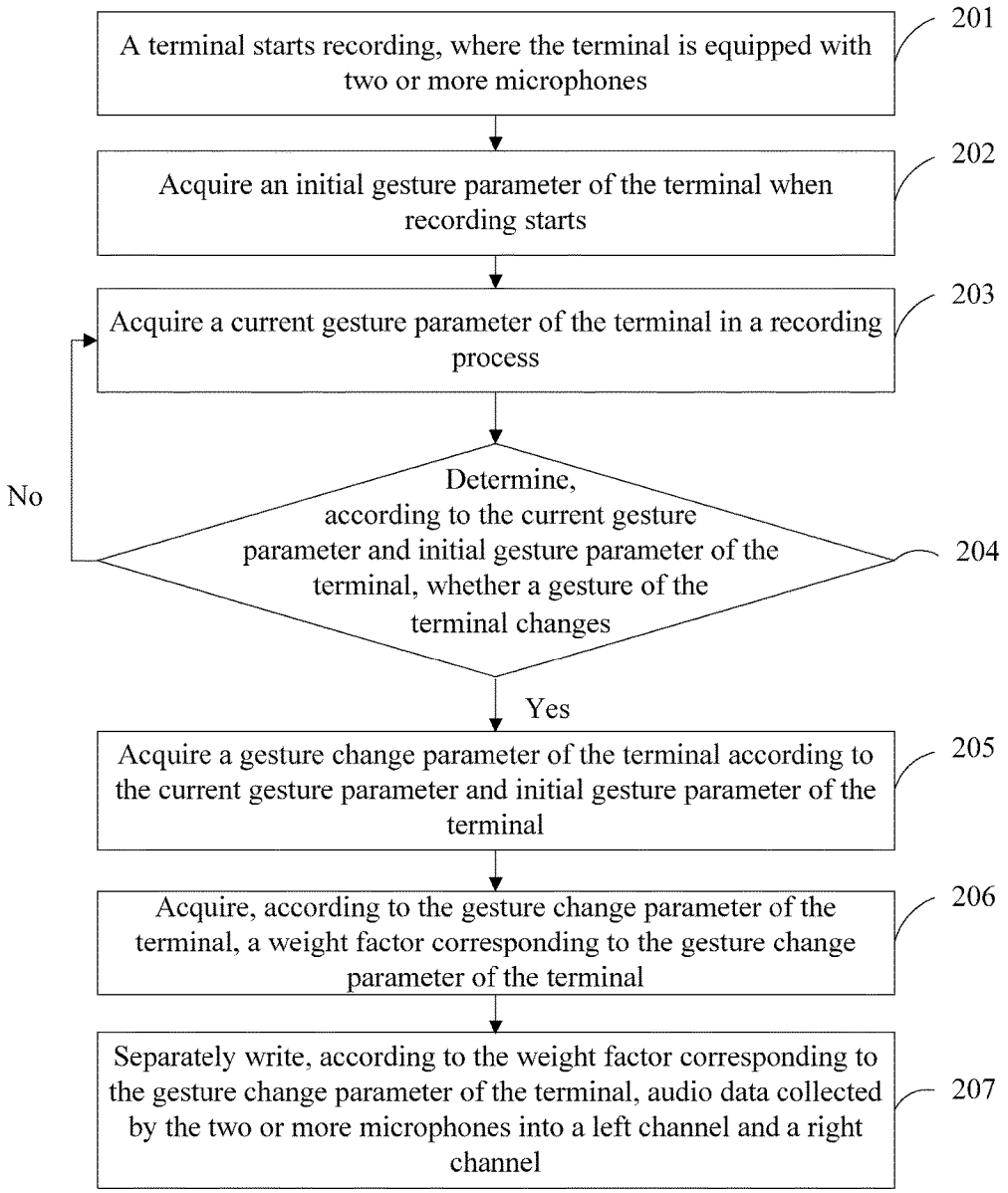
FIG. 2 is a flowchart of a stereophonic sound recording method according to an embodiment of the present disclosure.

FIG. 2 is a flowchart of a stereophonic sound recording method according to an embodiment of the present disclosure. Referring to FIG. 2, the method includes the following steps.

201. A terminal starts recording, where the terminal is equipped with two or more microphones.

Optionally, the terminal includes a fixed terminal or a mobile terminal that has a recording function. The fixed terminal may be personal computer (PC) or a display device. The mobile terminal may be a smartphone, a tablet computer, a Moving Picture Experts Group Audio Layer III (MP3) player, a personal digital assistant (PDA), or the like.

Optionally, the terminal is equipped with two or more microphones. The two or more microphones may be disposed at different locations in the terminal, and microphones at different locations collect audio data in different parts of a sound field and separately write the collected audio data into a left channel and a right channel, so as to produce an effect of a stereophonic sound field.

202. Acquire an initial gesture parameter of the terminal when the recording starts.

The terminal is equipped with a sensor.

Optionally, when the recording starts, the initial gesture parameter of the terminal is acquired by using the sensor.

Optionally, the sensor in this embodiment includes a magnetic field sensor, a gyro sensor, a six-axis orientation sensor, a nine-axis rotation vector sensor, and the like. Gesture parameters of the terminal acquired by different sensors may be different. For example, a gesture parameter of the terminal acquired by the magnetic field sensor is a direction of the terminal in a world coordinate system; a gesture parameter acquired by the gyro sensor is an angular velocity of the terminal in each axial direction; a gesture parameter acquired by the six-axis orientation sensor is a current orientation angle of the terminal.

203. Acquire a current gesture parameter of the terminal in a recording process.

Step 203 may include either of the following implementation manners: (1) In the recording process, a gesture parameter output by the sensor of the terminal is periodically acquired. In a period from start of recording to end of recording, the current gesture parameter detected by the sensor that is disposed in the terminal may be acquired at a preset interval. The preset interval may be preset by a technician, which is not limited in this embodiment of the present disclosure. (2) In the recording process, the sensor of the terminal is monitored, and when a gesture parameter output by the sensor is different from the initial gesture parameter, the gesture parameter output by the sensor is acquired and used as the current gesture parameter of the terminal. In a period from start of recording to end of recording, a data interface between the sensor and the terminal is monitored, and when data is output, the data output by the sensor is acquired and used as the current gesture parameter of the terminal.

204. Determine, according to the current gesture parameter and initial gesture parameter of the terminal, whether a gesture of the terminal changes.

If the gesture of the terminal changes, step 205 is performed.

If the gesture of the terminal does not change, step 203 is performed.

Optionally, a method for determining whether the gesture of the terminal changes may be as follows. When the current gesture parameter of the terminal is different from the initial gesture parameter of the terminal, it is considered that the gesture of the terminal changes; when the current gesture parameter of the terminal is the same as the initial gesture parameter of the terminal, it is considered that the gesture of the terminal does not change. Optionally, the method for determining whether the gesture of the terminal changes may further be as follows. When a variation between the current gesture parameter and initial gesture parameter of the terminal exceeds a preset threshold, it is considered that the gesture of the terminal changes; when the variation between the current gesture parameter and initial gesture parameter of the terminal does not exceed the preset threshold, it is considered that the gesture of the terminal does not change.

205. Acquire a gesture change parameter of the terminal according to the current gesture parameter and initial gesture parameter of the terminal.

In a case in which the terminal is equipped with different sensors, step 205 includes but is not limited to the following implementation manners.

Figure 3:
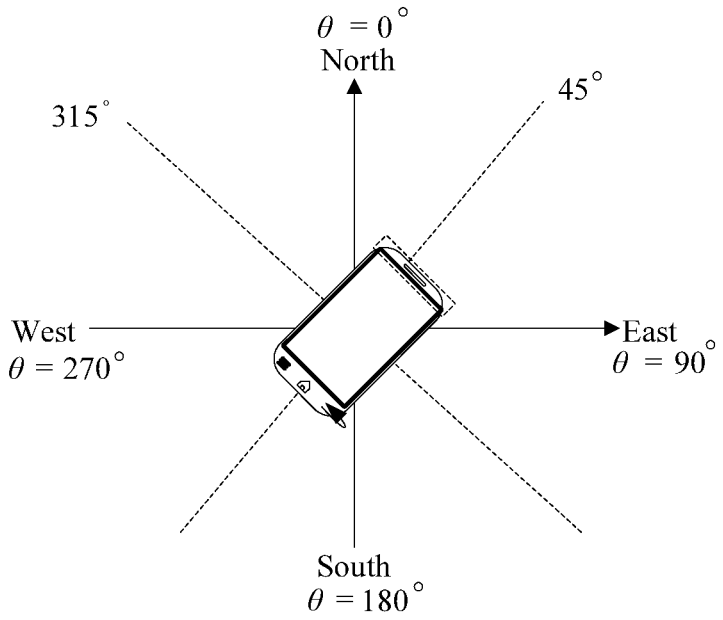
FIG. 3 is a schematic diagram of a correspondence between a facing direction of a terminal head and an angle according to an embodiment of the present disclosure.

(1) When the terminal is equipped with the magnetic field sensor, the gesture parameter of the terminal acquired by the magnetic field sensor is the direction of the terminal in the world coordinate system. According to the current gesture parameter and initial gesture parameter in the recording process, a change of the direction of the terminal in the world coordinate system is determined, and the gesture change parameter of the terminal from an initial gesture to a current gesture is calculated. FIG. 3 shows a correspondence between a facing direction of a terminal head and an angle according to this embodiment of the present disclosure. When the recording starts, the terminal is horizontally placed with the front side facing upwards, where a y-axis indicates the facing direction of the terminal head. When the y-axis points to the north pole of the earth, an x-axis points to the east, and a z-axis is perpendicular to the center of the earth and upward, an angle corresponding to the direction is 0° in this case. When the gesture of the terminal changes, and a current gesture of the terminal is that the y-axis points to the due east, an angle corresponding to the direction is 90° in this case. Therefore, a gesture change parameter $\Delta\theta=90°$ of the terminal from an initial gesture to a current gesture can be calculated.

Figure 4:
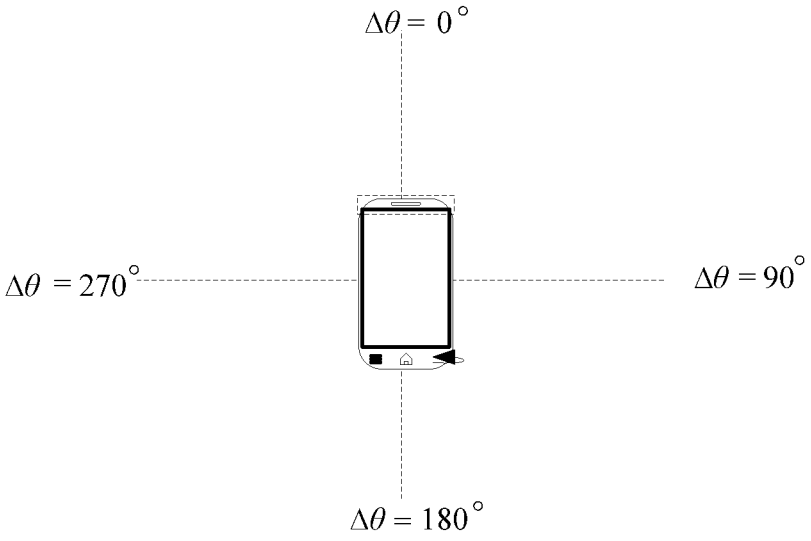
FIG. 4 is a schematic diagram of a rotation angle of a terminal according to an embodiment of the present disclosure.

(2) When the terminal is equipped with the gyro sensor, the gesture parameter of the terminal acquired by the gyro sensor is the angular velocity of the terminal in each axial direction. According to the current gesture parameter and initial gesture parameter in the recording process, a change of the angular velocity of the terminal in each axial direction is determined, and the gesture change parameter of the terminal from an initial gesture to a current gesture is calculated. FIG. 4 is a schematic diagram of a rotation angle of the terminal according to this embodiment of the present disclosure. When the recording starts and the gesture of the terminal does not change, the rotation angle of the terminal is $\Delta\theta=0°$ in this case. When the gesture of the terminal changes, a rotated angle $\Delta\theta=90°$ that the terminal rotates around an axis (the z-axis or the x-axis) from time when the recording starts to current time can be acquired by performing integration on a current angular velocity of the terminal, that is, a gesture change parameter of the terminal is $\Delta\theta=90°$.

(3) When the terminal is equipped with the six-axis orientation sensor, the gesture parameter of the terminal acquired by the six-axis orientation sensor is the orientation angle of the terminal. According to the current gesture parameter and initial gesture parameter in the recording process, a change of the orientation angle of the terminal is determined, and the gesture change parameter of the terminal from an initial gesture to a current gesture is calculated. For example, when the recording starts and the terminal head points to the sky, an orientation angle 0° of the terminal is acquired in this case. When the gesture of the terminal changes, and the terminal head horizontally faces rightwards, an orientation angle 90° of the terminal is acquired in this case. Therefore, a gesture change parameter $\Delta\theta=90°$ of the terminal from an initial gesture to a current gesture can be calculated.

(4) When the terminal is equipped with the nine-axis rotation vector sensor, and it is determined, according to the current gesture parameter and initial gesture parameter of the terminal, that the gesture of the terminal changes, the initial gesture parameter of the terminal acquired by the sensor is converted into a vector $\vec{\alpha}=(x_o,y_o,z_o)$ in the world coordinate system, the current gesture parameter of the terminal is converted into a vector $\vec{\beta}=(x_c,y_c,z_c)$ in the world coordinate system, and the vector $\vec{\alpha}$ and the vector $\vec{\beta}$ obtained after the conversion are substituted into a formula $$\cos\Delta\theta = \cos\langle\vec{\alpha},\vec{\beta}\rangle = \frac{\vec{\alpha}\cdot\vec{\beta}}{|\vec{\alpha}|*|\vec{\beta}|},$$

to calculate the gesture change parameter $\Delta\theta$ of the terminal from the initial gesture to the current gesture, where $x_o,y_o,z_o \in Z$.

206. Acquire, according to the gesture change parameter of the terminal, a weight factor corresponding to the gesture change parameter of the terminal, where the weight factor is used to adjust a proportion of audio data, collected by each microphone, to be written into a left channel and a right channel, and there is a preset correspondence between the gesture change parameter and the weight factor.

The preset correspondence is set or adjusted by a technician during terminal development. The weight factor that is corresponding to the gesture change parameter and is obtained by calculation may be learned according to the preset correspondence.

Preferably, in a case in which the terminal is equipped with two microphones, one gesture change parameter may be corresponding to one weight factor. The weight factor is a weight factor corresponding to a primary microphone of the two microphones, and a secondary microphone is corresponding to a value of (1−weight factor).

However, in a case in which the terminal is equipped with more than two microphones, a gesture change parameter may be corresponding to weight factors of various microphones, that is, one gesture change parameter is corresponding to multiple weight factors. For example, for a terminal that has three microphones, one gesture change parameter may be corresponding to weight factors of the three microphones, which are respectively 0.2, 0.5, and 0.3.

In the preset correspondence, the correspondence between the gesture change parameter and the weight factor may be a linear relationship or a nonlinear relationship, which is not limited in this embodiment of the present disclosure.

207. Separately write, according to the weight factor corresponding to the gesture change parameter of the terminal, audio data collected by the two or more microphones into the left channel and the right channel.

The audio data collected by each microphone is written into the left channel and the right channel according to the weight factor of each microphone corresponding to the gesture change parameter of the terminal, and according to a proportion of a current weight factor of the microphone.

For example, a terminal is equipped with three microphones, which are A, B, and C. It is determined, according to a gesture change parameter of the terminal, that a weight factor of microphone A is 0.3, a weight factor of microphone B is 0.4, and a weight factor of microphone C is 0.3. In this case, 30% of audio data collected by microphone A is written into a left channel, and 70% of the audio data is written into a right channel; 40% of audio data collected by microphone B is written into the left channel, and 60% of the audio data is written into the right channel; 30% of audio data collected by microphone C is written into the left channel, and 70% of the audio data is written into the right channel, thereby implementing stereophonic sound recording. A correspondence between the microphone and a sound channel into which the microphone writes data may be set by a technician during terminal development.

Only an example in which two or more microphones of the terminal are a primary microphone and a secondary microphone is used for description in the following. The details are as follows.

Figure 5:
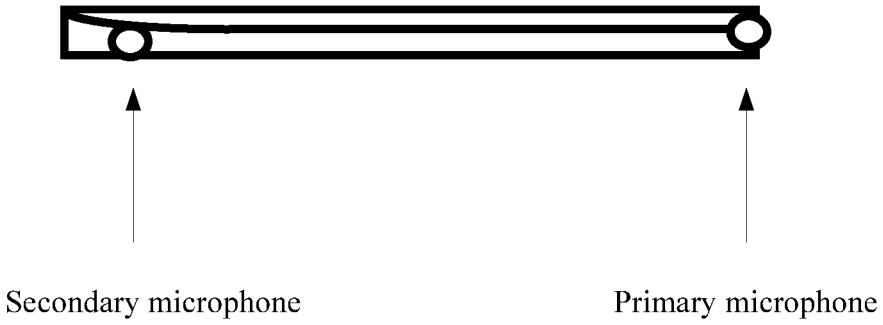
FIG. 5 is a schematic diagram of horizontal placement of a terminal according to an embodiment of the present disclosure.

When the recording starts, a schematic diagram of the initial gesture of the terminal is shown in FIG. 5, in which the terminal is horizontally placed; the terminal head is at the left end, and the secondary microphone is at the back of the terminal; the terminal tail is at the right end, and the primary microphone is at the bottom of the terminal.

Figure 6:
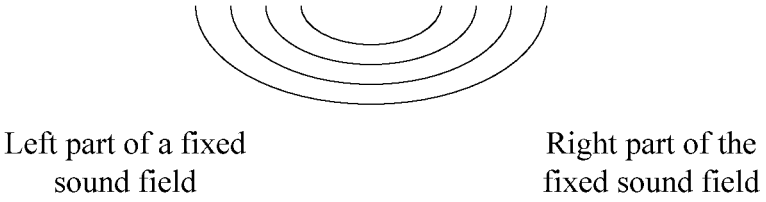
FIG. 6 is a schematic diagram of a sound field according to an embodiment of the present disclosure.

A sound field shown in FIG. 6 exists around the terminal, where the left part and the right part of the sound field have different timbres, for example, there is a wind instrument in the left part, and there is a string instrument in the right part. The primary microphone of the terminal mainly collects audio data in the right part of the sound field, and the secondary microphone mainly collects audio data in the left part of the sound field.

Figure 7:
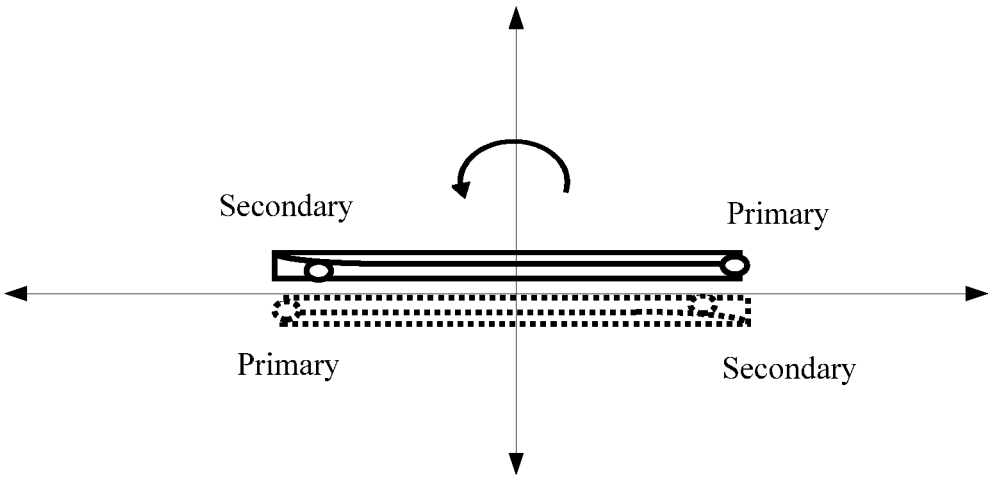
FIG. 7 is a schematic diagram of a gesture change of a terminal according to an embodiment of the present disclosure.

Optionally, the terminal in this embodiment is equipped with the nine-axis rotation vector sensor, and a gesture parameter of the terminal acquired by the nine-axis rotation vector sensor is a rotation vector of the terminal in the world coordinate system. FIG. 7 is a schematic diagram of a gesture change of the terminal. Solid lines in the figure indicate a gesture of the terminal when the recording starts, and dotted lines indicate a current gesture of the terminal. When the recording starts, a gesture parameter of the terminal acquired by the sensor is a rotation vector $\vec{\alpha}'$ of the terminal in the world coordinate system, and when the terminal rotates to a gesture shown by the dotted lines in the figure, a gesture parameter of the terminal acquired by the sensor is a rotation vector $\vec{\beta}'$. When it is determined, according to the current gesture parameter and initial gesture parameter of the terminal, that the gesture of the terminal changes, the initial gesture parameter $\vec{\alpha}'$ of the terminal acquired by the sensor is converted into a vector $\vec{\alpha}=(x_o,y_o,z_o)$ in the world coordinate system, the current gesture parameter $\vec{\beta}'$ of the terminal is converted into a vector $\vec{\beta}=(x_c,y_c,z_c)$ in the world coordinate system, and the vector $\vec{\alpha}$ and the vector $\vec{\beta}$ after the conversion are substituted into the formula $$\cos\Delta\theta = \cos\langle\vec{\alpha}, \vec{\beta}\rangle = \frac{\vec{\alpha}\cdot\vec{\beta}}{|\vec{\alpha}|*|\vec{\beta}|},$$

to calculate the gesture change parameter $\Delta\theta$ of the terminal from the initial gesture to the current gesture, where $x_o,y_o,z_o \in Z$.

Figure 8:
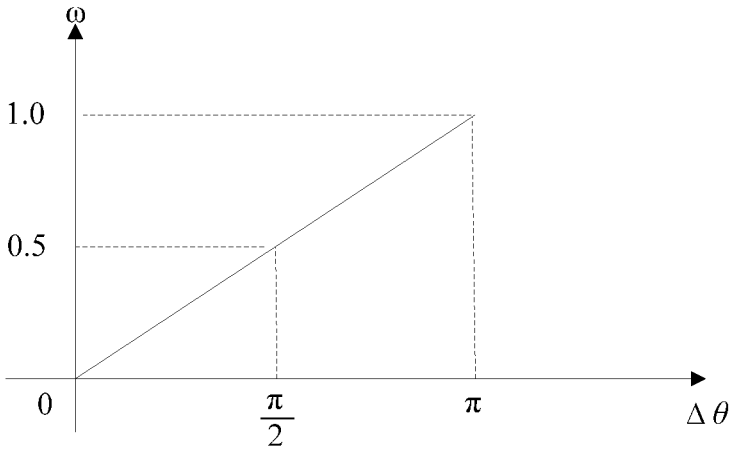
FIG. 8 is a schematic diagram of a correspondence between a current gesture change parameter of a terminal and a weight factor of a primary microphone according to an embodiment of the present disclosure.

Optionally, in this embodiment, the correspondence, as shown in FIG. 8, between the current gesture change parameter of the device and the weight factor of the primary microphone is used, where $\Delta\theta$ indicates the current gesture change parameter of the terminal, and $\omega$ indicates a weight factor of audio data that is written by the primary microphone into the left channel (or the right channel). The current gesture change parameter $\Delta\theta$ of the terminal and the weight factor $\omega$ of the primary microphone (in this case, the weight factor of the secondary microphone is $(1-\omega)$) are in a linear relationship that has a specific slope.

Optionally, the audio data collected by the primary microphone and the secondary microphone is separately written into the left channel and the right channel according to the weight factor corresponding to the gesture change parameter of the terminal and by using the following composition formulas of the left channel and the right channel:

$$L=S^*(1-\omega)+P^*(\omega)$$

$$R=S^*(\omega)+P^*(1-\omega)$$

where $\omega$ indicates the weight factor, L indicates the left channel, R indicates the right channel, S indicates the audio data collected by the secondary microphone, and P indicates the audio data collected by the primary microphone. That is, in the recording process, when the gesture of the terminal rotates, the gesture change parameter $\Delta\theta$ and the weight factor $\omega$ corresponding to the primary microphone are generated. In this case, the primary microphone writes the collected audio data into the left channel according to a proportion of $\omega$, and writes the collected audio data into the right channel according to a proportion of $(1-\omega)$; the secondary microphone writes the collected audio data into the left channel according to the proportion of $(1-\omega)$, and writes the collected audio data into the right channel according to the proportion of $\omega$. In a terminal rotating process, the audio data collected by the primary microphone and the secondary microphone is written into the left channel and the right channel according to the weight factor, which ensures stability of the sound field in the terminal rotating process.

When the current gesture change parameter of the terminal is $\Delta\theta=0°$, the corresponding weight factor of the primary microphone is $\omega=0$. In this case, the primary microphone mainly collects a sound in the right part of the sound field, and the secondary microphone mainly collects a sound in the left part of the sound field.

When the current gesture change parameter of the terminal is $$\Delta\theta = \frac{\pi}{2},$$

the corresponding weight factor of the primary microphone is $\omega=0.5$. In this case, the primary microphone writes the collected audio data into the left channel according to a proportion of 0.5, and writes the collected audio data into the right channel according to a proportion of 0.5; the secondary microphone writes the collected audio data into the left channel according to the proportion of 0.5, and writes the collected audio data into the right channel according to the proportion of 0.5.

When the current gesture change parameter of the terminal is $\Delta\theta=\pi$, the corresponding weight factor of the primary microphone is $\omega=1$. In this case, the primary microphone writes the collected audio data into the left channel according to a proportion of 1, and writes the collected audio data into the right channel according to a proportion of 0; the secondary microphone writes the collected audio data into the left channel according to the proportion of 0, and writes the collected audio data into the right channel according to the proportion of 1. That is, the primary microphone mainly collects the sound in the left part of the sound field, and the secondary microphone mainly collects the sound in the right part of the sound field. In this way, by changing composition of audio data in the left channel and the right channel in real time, an effect that the recording sound field is kept consistent with a real sound field is achieved, that is, stability of the recording sound field is kept.

It should be noted that the composition formulas of the left channel and the right channel are not limited to those enumerated in the foregoing embodiment, and other formulas may also be used provided that the formulas can achieve an effect of keeping the stability of the recording sound field.

In this embodiment of the present disclosure, a current gesture parameter of a terminal is acquired in real time, and when it is determined, by comparing the current gesture parameter with an initial gesture parameter of the terminal, that a gesture of the terminal changes, a weight factor of audio data that is written by multiple microphones into a left channel and a right channel is calculated, and then a proportion of the audio data that is written by the multiple microphones into the left channel and the right channel is adjusted according to the weight factor, so that a sound field is not affected by a gesture change of the terminal and stability of a sound field of stereophonic sound recording is ensured.

Figure 9:
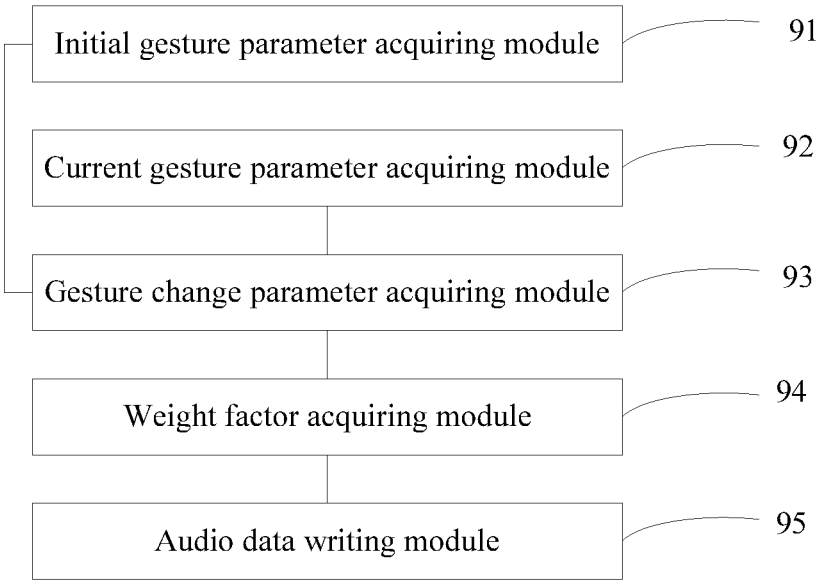
FIG. 9 is a schematic structural diagram of a stereophonic sound recording apparatus according to an embodiment of the present disclosure.

FIG. 9 is a schematic structural diagram of a stereophonic sound recording apparatus according to an embodiment of the present disclosure. Referring to FIG. 9, the embodiment includes an initial gesture parameter acquiring module 91, a current gesture parameter acquiring module 92, a gesture change parameter acquiring module 93, a weight factor acquiring module 94, and an audio data writing module 95.

The initial gesture parameter acquiring module 91 is configured to acquire an initial gesture parameter of a terminal when recording starts, where the terminal is equipped with two or more microphones. The current gesture parameter acquiring module 92 is configured to acquire a current gesture parameter of the terminal in a recording process. The gesture change parameter acquiring module 93 is connected to the initial gesture parameter acquiring module 91, and the gesture change parameter acquiring module 93 is connected to the current gesture parameter acquiring module 92. The gesture change parameter acquiring module 93 is configured to acquire a gesture change parameter of the terminal when it is determined, according to the current gesture parameter and initial gesture parameter of the terminal, that a gesture of the terminal changes. The weight factor acquiring module 94 is connected to the gesture change parameter acquiring module 93. The weight factor acquiring module 94 is configured to acquire, according to the gesture change parameter of the terminal, a weight factor corresponding to the gesture change parameter of the terminal, where the weight factor is used to adjust a proportion of audio data, collected by each microphone, to be written into a left channel and a right channel, and there is a preset correspondence between the gesture change parameter and the weight factor. The audio data writing module 95 is connected to the weight factor acquiring module 94. The audio data writing module 95 is configured to separately write, according to the weight factor corresponding to the gesture change parameter of the terminal, audio data collected by the two or more microphones into the left channel and the right channel.

Optionally, the terminal is equipped with a sensor. The current gesture parameter acquiring module 92 is configured to periodically acquire a gesture parameter output by the sensor of the terminal and use the gesture parameter as the current gesture parameter in the recording process; or the current gesture parameter acquiring module 92 is configured to monitor the sensor of the terminal in the recording process, and when a gesture parameter output by the sensor is different from the initial gesture parameter, acquire the gesture parameter output by the sensor and use the gesture parameter as the current gesture parameter of the terminal.

Optionally, the gesture change parameter acquiring module 93 includes an initial gesture parameter converting unit 931, a current gesture parameter converting unit 932, and a gesture change parameter determining unit 933.

The initial gesture parameter converting unit 931 is configured to convert the initial gesture parameter of the device into a vector $\vec{\alpha}=(x_o,y_o,z_o)$ in a world coordinate system. The current gesture parameter converting unit 932 is connected to the initial gesture parameter converting unit 931. The current gesture parameter converting unit 932 is configured to convert the current gesture parameter of the device into a vector $\vec{\beta}=(x_c,y_c,z_c)$ in the world coordinate system. The gesture change parameter determining unit 933 is connected to the current gesture parameter converting unit 932. The gesture change parameter determining unit 933 is configured to determine a gesture change parameter $\Delta\theta$ of the gesture of the terminal by using a formula $$\cos\Delta\theta = \cos\langle\vec{\alpha}, \vec{\beta}\rangle = \frac{\vec{\alpha}\cdot\vec{\beta}}{|\vec{\alpha}|*|\vec{\beta}|},$$

where $x_o,y_o,z_o \in Z$.

Optionally, the audio data writing module 95 is configured to, when the two or more microphones are respectively a primary microphone and a secondary microphone, separately write, according to the weight factor corresponding to the gesture change parameter of the terminal and by using the following composition formulas of the left channel and the right channel, the audio data collected by the primary microphone and the secondary microphone into the left channel and the right channel:

$$L=S^*(1-\omega)+P^*(\omega)$$

$$R=S^*(\omega)+P^*(1-\omega)$$

where ω indicates the weight factor, L indicates the left channel, R indicates the right channel, S indicates the audio data collected by the secondary microphone, and P indicates the audio data collected by the primary microphone.

In this embodiment of the present disclosure, a current gesture parameter of a terminal is acquired in real time, and when it is determined, by comparing the current gesture parameter with an initial gesture parameter of the terminal, that a gesture of the terminal changes, a weight factor of audio data that is written by multiple microphones into a left channel and a right channel is calculated, and then a proportion of the audio data that is written by the multiple microphones into the left channel and the right channel is adjusted according to the weight factor, so that a sound field is not affected by a gesture change of the terminal and stability of a sound field of stereophonic sound recording is ensured.

It should be noted that, when a stereophonic sound is recorded by the stereophonic sound recording apparatus provided in the foregoing embodiment, description is given only by using division of the foregoing functional modules. In an actual application, the foregoing functions may be implemented by different functional modules according to a requirement. That is, an internal structure of the apparatus is divided into different functional modules to implement all or a part of the functions described above. In addition, the stereophonic sound recording apparatus provided in the foregoing embodiments pertains to a same concept as the embodiments of the stereophonic sound recording method. For a specific implementation process of the stereophonic sound recording apparatus, refer to the method embodiments, and details are not described herein again.

A person of ordinary skill in the art may understand that all or a part of the steps of the embodiment may be implemented by hardware or a program instructing related hardware. The program may be stored in a computer readable storage medium. The foregoing storage medium may be a read-only memory, a magnetic disk, an optical disc, or the like.

Figure 10:
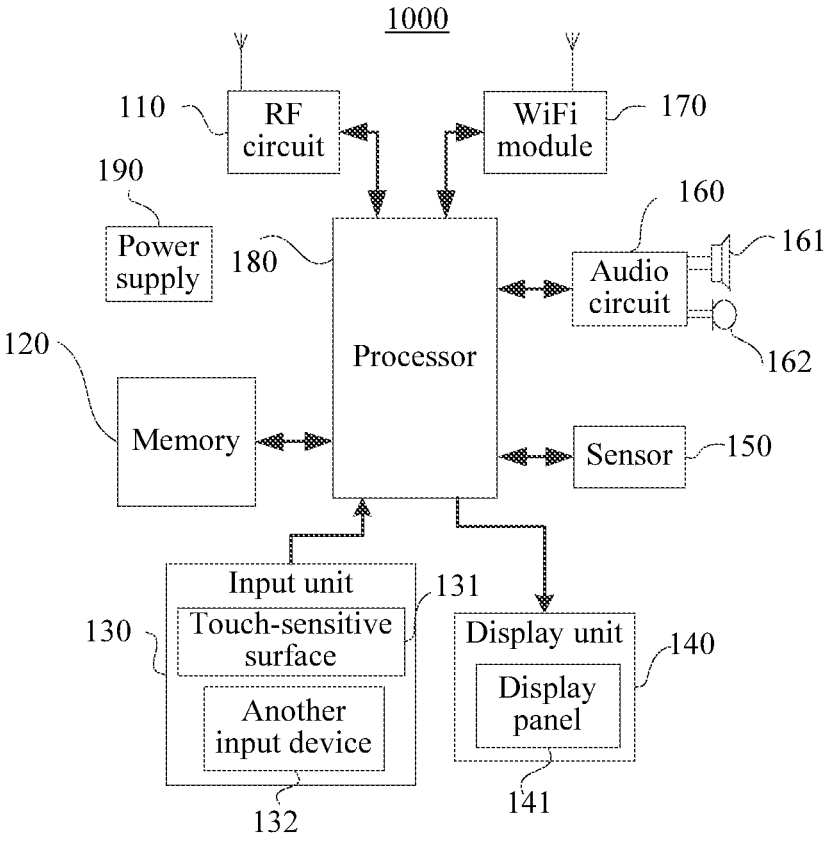
FIG. 10 is a schematic structural diagram of a terminal according to an embodiment of the present disclosure.

FIG. 10 is a schematic structural diagram of a terminal according to an embodiment of the present disclosure. The terminal may be configured to implement the stereophonic sound recording method according to the foregoing embodiments.

A terminal 1000 may include parts such as a radio frequency (RF) circuit 110, a memory 120 that includes one or more computer readable storage media, an input unit 130, a display unit 140, a sensor 150, an audio circuit 160, a wireless fidelity (WiFi) module 170, a processor 180 that includes one or more processing cores, and a power supply 190. A person skilled in the art may understand that a structure of the terminal shown in FIG. 10 does not constitute a limitation on the terminal, and may include more or less parts than those shown in the figure, a combination of some parts, or different part placements.

The RF circuit 110 may be configured to receive and send a signal in an information receiving or sending process or a call process, and in particular, after receiving downlink information of a base station, send the downlink information to the processor 180 that includes one or more processing cores for processing, and in addition, send related uplink data to the base station. Generally, the RF circuit 110 includes but is not limited to an antenna, at least one amplifier, a tuner, one or more oscillators, a subscriber identity module (SIM) card, a transceiver, a coupler, a low noise amplifier (LNA), a duplexer, and the like. In addition, the RF circuit 110 may further communicate with a network and another device by means of wireless communication. The wireless communication may use any communications standard or protocol, including but not limited to Global System for Mobile Communications (GSM), General Packet Radio Service (GPRS), Code Division Multiple Access (CDMA), Wideband Code Division Multiple Access (WCDMA), Long Term Evolution (LTE), electronic mail (email), Short Messaging Service (SMS), and the like.

The memory 120 may be configured to store a software program and a module, and the processor 180 executes, by running the software program and the module that are stored in the memory 120, various functional applications and data processing. The memory 120 may mainly include a program storage area and a data storage area. The program storage area may store an operating system, an application program that is required by at least one function (such as a sound playing function or an image playing function), and the like. The data storage area may store data (such as audio data or a phone book) that is created according to use of the terminal 1000, and the like. In addition, the memory 120 may include a high-speed random access memory, and may further include a non-volatile memory, such as at least one magnetic disk storage device, a flash memory device, or another volatile solid-state storage device. Correspondingly, the memory 120 may further include a memory controller, so as to provide the processor 180 and the input unit 130 with access to the memory 120.

The input unit 130 may be configured to receive input digital or character information, and produce a signal input that is of a keyboard, a mouse, a joystick, optics, or a trackball, and that is related to a user setting and function control. The input unit 130 may include a touch-sensitive surface 131 and another input device 132. The touch-sensitive surface 131, also referred to as a touchscreen or a touchpad, may collect a touch operation (such as an operation performed by a user on the touch-sensitive surface 131 or near the touch-sensitive surface 131 by using a finger, a stylus, or any suitable object or accessory) of a user on or near the touch-sensitive surface, and drive a corresponding connection apparatus according to a preset formula. Optionally, the touch-sensitive surface 131 may include two parts: a touch detecting apparatus and a touch controller. The touch detecting apparatus detects a touch location of a user, detects a signal brought by the touch operation, and sends the signal to the touch controller. The touch controller receives touch information from the touch detecting apparatus, converts the touch information into touch point coordinates, and then sends the touch coordinates to the processor 180, and can receive and execute a command sent by the processor 180. In addition, the touch-sensitive surface 131 may be implemented in multiple types, such as a resistance type, a capacitor type, an infrared ray, and a surface acoustic wave. In addition to the touch-sensitive surface 131, the input unit 130 may further include another input device 132. The another input device 132 may include but is not limited to one or more of a physical keyboard, a function key (such as a volume control key or a switch key), a trackball, a mouse, a joystick, or the like.

The display unit 140 may be configured to display information input by a user or information provided to a user, and various graphic user interfaces of the terminal 1000, where the graphic user interfaces may be formed by a graphic, a text, an icon, a video, and any combination of them. The display unit 140 may include a display panel 141. Optionally, the display panel 141 may be configured in a form of a liquid crystal display (LCD), an organic light-emitting diode (OLED), or the like. Further, the touch-sensitive surface 131 may cover the display panel 141. When the touch-sensitive surface 131 detects a touch operation on or near the touch-sensitive surface 131, the touch-sensitive surface 131 sends a signal to the processor 180 so that the processor 180 determines a type of a touch event, and then the processor 180 provides a corresponding visual output on the display panel 141 according to the type of the touch event. Although, in FIG. 10, the touch-sensitive surface 131 and the display panel 141 are used as two standalone parts to implement input and output functions, but in some embodiments, the touch-sensitive surface 131 and the display panel 141 may be integrated to implement the input and output functions.

The terminal 1000 may further include at least one type of sensor 150, such as an optical sensor, a motion sensor, and another sensor. The optical sensor may include an ambient light sensor and a proximity sensor. The ambient light sensor may adjust luminance of the display panel 141 according to brightness or dimness of ambient light. The proximity sensor may turn off the display panel 141 and/or backlight when the terminal 1000 moves close to an ear. As a type of a motion sensor, a gravity acceleration sensor may detect a size of an acceleration in each direction (generally, three axes), and may detect a size and a direction of gravity in a still mode, and therefore may be used for an application that identifies a mobile phone gesture (such as screen switching between portrait and landscape modes, a related game, and magnetometer gesture calibration), a function related to vibration identification (such as a pedometer and a stroke), and the like. For other sensors that may further be disposed in the terminal 1000, such as a gyroscope, a barometer, a hygrometer, a thermometer, and an infrared sensor, details are not described herein again.

The audio circuit 160, a loudspeaker 161, and a microphone 162 can provide an audio interface between a user and the terminal 1000. The audio circuit 160 may transmit, to the loudspeaker 161, an electrical signal converted from received audio data, and the loudspeaker 161 converts the electrical signal into a sound signal for output. The microphone 162 converts a collected sound signal into an electrical signal, the audio circuit 160 receives the electrical signal and converts it into audio data and then outputs the audio data to the processor 180 for processing. Then the audio data is sent to, for example, another terminal, by using the RF circuit 110, or the audio data is output to the memory 120 for further processing. The audio circuit 160 may further include a jack for an earplug, so as to provide communication between an external earphone and the terminal 1000.

WiFi pertains to a short-range wireless transmission technology. The terminal 1000 may use a WiFi module 170 to help a user receive and send an email, browse a web page, gain access to streaming media, and the like. The WiFi module 170 provides the user with wireless broadband Internet access. Although FIG. 10 shows the WiFi module 170, it can be understood that the WiFi module 170 is not a mandatory part of the terminal 1000, and may be completely omitted according to a requirement without changing the essence of the present disclosure.

The processor 180 is a control center of the terminal 1000. Various interfaces and lines are used to connect various parts of an entire mobile phone. The processor 180 executes, by running or executing a software program and/or a module that are stored in the memory 120 and by invoking data stored in the memory 120, various functions of the terminal 1000, and processes data, so as to perform overall monitoring on the mobile phone. Optionally, the processor 180 may include one or more processing cores. Preferably, the processor 180 may integrate an application processor and a modem processor. The application processor mainly processes an operating system, a user interface, an application program, and the like, and the modem processor mainly processes wireless communication. It can be understood that the foregoing modem processor may also not be integrated into the processor 180.

The terminal 1000 further includes the power supply 190 (such as a battery) that supplies power to all parts. Preferably, the power supply may be logically connected to the processor 180 by using a power management system, so that the power management system implements functions such as charging management, discharging management, and power consumption management. The power supply 190 may further include one or more of any components such as a direct current or alternating current power supply, a rechargeable system, a power failure detection circuit, a power converter or an inverter, and a power status indicator.

Although not shown in the figure, the terminal 1000 may further include a camera, a Bluetooth module, and the like, which are not described herein again. In this embodiment, a display unit of the terminal is a touchscreen, and the terminal further includes a memory, and one or more programs, where the one or more programs are stored in the memory, and after configuration, a processor that includes one or more processing cores executes the one or more programs that include an instruction used for performing the following operations: acquiring an initial gesture parameter of the terminal when recording starts, where the terminal is equipped with two or more microphones; acquiring a current gesture parameter of the terminal in a recording process; acquiring a gesture change parameter of the terminal when it is determined, according to the current gesture parameter and initial gesture parameter of the terminal, that a gesture of the terminal changes; acquiring, according to the gesture change parameter of the terminal, a weight factor corresponding to the gesture change parameter of the terminal, where the weight factor is used to adjust a proportion of audio data, collected by each microphone, to be written into a left channel and a right channel, and there is a preset correspondence between the gesture change parameter and the weight factor; and separately writing, according to the weight factor corresponding to the gesture change parameter of the terminal, audio data collected by the two or more microphones into the left channel and the right channel.

Optionally, an instruction used for performing the following operations is further included: periodically acquiring a gesture parameter output by the sensor of the terminal and using the gesture parameter as the current gesture parameter in the recording process; or monitoring the sensor of the terminal in the recording process, and when a gesture parameter output by the sensor is different from the initial gesture parameter, acquiring the gesture parameter output by the sensor and using the gesture parameter as the current gesture parameter of the terminal.

Optionally, an instruction used for performing the following operations is further included: converting the initial gesture parameter of the terminal into a vector $\vec{\alpha}=(x_o,y_o,z_o)$ in a world coordinate system; converting the current gesture parameter of the terminal into a vector $\vec{\beta}=(x_c,y_c,z_c)$ in the world coordinate system; and determining a gesture change parameter $\Delta\theta$ of the gesture of the terminal by using a formula $$\cos\Delta\theta = \cos\langle\vec{\alpha}, \vec{\beta}\rangle = \frac{\vec{\alpha}\cdot\vec{\beta}}{|\vec{\alpha}|*|\vec{\beta}|},$$

where $x_o,y_o,z_o \in Z$.

Optionally, an instruction used for performing the following operations is further included: separately writing, according to the weight factor corresponding to the gesture change parameter of the terminal and by using the following composition formulas of the left channel and the right channel, the audio data collected by the primary microphone and the secondary microphone into the left channel and the right channel:

$$L=S*(1-\omega)+P*(\omega)$$

$$R=S*(\omega)+P*(1-\omega)$$

where $\omega$ indicates the weight factor, L indicates the left channel, R indicates the right channel, S indicates the audio data collected by the secondary microphone, and P indicates the audio data collected by the primary microphone.

The foregoing descriptions are merely exemplary embodiments of the present disclosure, but are not intended to limit the present disclosure. Any modification, equivalent replacement, and improvement made without departing from the spirit and principle of the present disclosure shall fall within the protection scope of the present disclosure.

What is claimed is:

1. A stereophonic sound recording method, comprising:

acquiring an initial gesture parameter of a terminal when recording starts, wherein the terminal is equipped with a first microphone, a second microphone, and a third microphone;

acquiring a current gesture parameter of the terminal in a recording process;

acquiring a gesture change parameter of the terminal when it is determined, according to the current gesture parameter and the initial gesture parameter of the terminal, that a gesture of the terminal changes;

acquiring, according to the gesture change parameter of the terminal, weight factors that include a separate weight factor for each microphone of the first, second, and third microphones, wherein the weight factors include a first weight factor for the first microphone, a second weight factor for the second microphone, and a third weight factor for the third microphone, and wherein a preset correspondence exists between the gesture change parameter and the weight factors; and writing audio data collected by the first, second, and third microphones into a left channel and a right channel by writing:

a first proportion of first audio data from the first microphone to the left channel, wherein the first proportion corresponds to the first weight factor;

a second proportion of second audio data from die second microphone to the left channel, wherein the second proportion corresponds to the second weight factor;

a third proportion of third audio data from the third microphone to the left channel, wherein the third proportion corresponds to the third weight factor;

a fourth proportion of the first audio data from the first microphone to the right channel, wherein the fourth proportion corresponds to one minus the first weight factor;

a fifth proportion of the second audio data from the second microphone to the right channel, wherein the fifth proportion corresponds to one minus the second weight factor; and a sixth proportion of the third audio data from the third microphone to the right channel, wherein the sixth proportion corresponds to one minus the third weight factor.

2. The method according to claim 1, wherein the terminal is equipped with a sensor, and wherein acquiring the current gesture parameter of the terminal in the recording process comprises periodically acquiring a gesture parameter output by the sensor of the terminal and using the gesture parameter output by the sensor of the terminal as the current gesture parameter in the recording process.

3. The method according to claim 1, wherein the terminal is equipped with a sensor, and wherein acquiring the current gesture parameter of the terminal in the recording process comprises:

monitoring the sensor of the terminal in the recording process; and acquiring a gesture parameter output by the sensor and using the gesture parameter as the current gesture parameter of the terminal when the gesture parameter output by the sensor is different from the initial gesture parameter.

4. The method according to claim 1 wherein acquiring the gesture change parameter of the terminal when it is determined, according to the current gesture parameter and the initial gesture parameter of the terminal, that the gesture of the terminal changes comprises:

converting the initial gesture parameter of the terminal into a vector $\vec{\alpha}=(x_o,y_o,z_o)$ in a world coordinate system;

converting the current gesture parameter of the terminal into a vector $\vec{\beta}=(x_c,y_c,z_c)$ in the world coordinate system; and determining a gesture change parameter $\Delta\theta$ of the gesture of the terminal by using a formula $$\cos\Delta\theta = \cos\langle\vec{\alpha}, \vec{\beta}\rangle = \frac{\vec{\alpha}\cdot\vec{\beta}}{|\vec{\alpha}|*|\vec{\beta}|},$$

wherein $x_o,y_o,z_o \in Z$.

5. The method according to claim 1, wherein a sum of the first weight factor, the second weight factor, and the third weight factor equals one.

6. The method according to claim 1, wherein the first weight factor for the first microphone is linearly related to the gesture change parameter.

7. The method according to claim 1, wherein the gesture change parameter corresponds to an angle between the initial gesture parameter and the current gesture parameter, and wherein the preset correspondence indicates a particular weight factor of the plurality of weight factors that corresponds to the angle between the initial gesture parameter and the current gesture parameter.

8. The method according to claim 1, further comprising determining, according to the current gesture parameter and the initial gesture parameter, whether a gesture of the terminal changes, and wherein the gesture change parameter is acquired based on determining that the gesture of the terminal has changed.

9. The method according to claim 8, wherein determining whether the gesture of the terminal changes includes determining whether a variation between the current gesture parameter and the initial gesture parameter exceeds a preset threshold.

10. A stereophonic sound recording apparatus, comprising:

a memory; and a computer processor coupled to the memory and configured to:

acquire an initial gesture parameter of a terminal when recording starts, wherein the terminal is equipped with first, second, and third microphones;

acquire a current gesture parameter of the terminal in a recording process;

acquire a gesture change parameter of the terminal when it is determined, according to the current gesture parameter and the initial gesture parameter of the terminal, that a gesture of the terminal changes;

acquire, according to the gesture change parameter of the terminal, weight factors that include a separate weight factor for each microphone of the first, second, and third microphones, wherein the weight factors include a first weight factor for the first microphone, a second weight factor for the second microphone, and a third weight factor for the third microphone, and wherein a preset correspondence exists between the gesture change parameter and the weight factors; and write audio data collected by the first; second, and third microphones into a left channel and a right channel by writing:

a first proportion of first audio data from the first microphone to the left channel, wherein the first proportion corresponds to the first weight factor;

a second proportion of second audio data from the second microphone to the left channel, wherein the second proportion corresponds to the second weight factor;

a third proportion of third audio data from the third microphone to the left channel, wherein the third proportion corresponds to the third weight factor;

a fourth proportion of the first audio data from the first microphone to the right channel, wherein the fourth proportion corresponds to one minus the first weight factor;

a fifth proportion of the second audio data from the second microphone to the right channel, wherein the fifth proportion corresponds to one minus the second weight factor; and a sixth proportion of the third audio data from the third microphone to the right channel, wherein the sixth proportion corresponds to one minus the third weight factor.

11. The apparatus according to claim 10, wherein the terminal is equipped with a sensor, and wherein the computer processor is configured to periodically acquire a gesture parameter output by the sensor of the terminal and use the gesture parameter as the current gesture parameter in the recording process.

12. The apparatus according to claim 10, wherein the terminal is equipped with a sensor, and wherein the computer processor is configured to:

monitor the sensor of the terminal in the recording process; and acquire a gesture parameter output by the sensor and use the gesture parameter as the current gesture parameter of the terminal when the gesture parameter output by the sensor is different from the initial gesture parameter.

13. The apparatus according to claim 10, wherein the computer processor is configured to:

convert the initial gesture parameter of the terminal into a vector $\vec{\alpha}=(x_o,y_o,z_o)$ in a world coordinate system;

convert the current gesture parameter of the terminal into a vector $\vec{\beta}=(x_c,y_c,z_c)$ in the world coordinate system; and determine a gesture change parameter $\Delta\theta$ of the gesture of the terminal by using a formula $$\cos\Delta\theta = \cos\langle\vec{\alpha},\vec{\beta}\rangle = \frac{\vec{\alpha}\cdot\vec{\beta}}{|\vec{\alpha}|*|\vec{\beta}|},$$

wherein $x_o,y_o,z_o \in Z$.

14. A terminal, comprising:

a first microphone;

a second microphone;

a third microphone;

a memory storing one or more programs; and a processor coupled to the memory and to the first, second, and third microphones, wherein the processor comprises one or more processing cores configured to execute the one or more programs to:

acquire an initial gesture parameter of the terminal when recording starts;

acquire a current gesture parameter of the terminal in a recording process;

acquire a gesture change parameter of the terminal when it is determined, according to the current gesture parameter and the initial gesture parameter of the terminal, that a gesture of the terminal changes;

acquire, according to the gesture change parameter of the terminal, weight factors that include a separate weight factor for each microphone of the first, second, and third microphones, wherein the weight factors include a first weight factor for the first microphone, a second weight factor for the second microphone, and a third weight factor for the third microphone, and wherein a preset correspondence exists between the gesture change parameter and the weight factors; and write audio data collected by the first, second, and third microphones into a left channel and a right channel by writing;

a first proportion of first audio data from the first microphone to the left channel, wherein the first proportion corresponds to the first weight factor;

a second proportion of second audio data from the second microphone to the left channel, wherein the second proportion corresponds to the second weight factor;

a third proportion of third audio data from the third microphone to the left channel, wherein the third proportion corresponds to the third weight factor;

a fourth proportion of the first audio data from the first microphone to the right channel, wherein the fourth proportion corresponds to one minus the first weight factor;

a fifth proportion of the second audio data from the second microphone to the right channel, wherein the fifth proportion corresponds to one minus the second weight factor; and a sixth proportion of the third audio data from the third microphone to the right channel, wherein the sixth proportion corresponds to one minus the third weight factor.

* * * * *